US007047843B1

(12) United States Patent
Huang

(10) Patent No.: US 7,047,843 B1
(45) Date of Patent: May 23, 2006

(54) TOOL COUPLING DEVICE

(76) Inventor: Ping Wen Huang, No. 5, Alley 24, Lane 247, Sinyi St., Wurih Township, Taichung County 414 (TW)

( * ) Notice: Subject to any disclaimer, the term of this patent is extended or adjusted under 35 U.S.C. 154(b) by 0 days.

(21) Appl. No.: 11/168,510

(22) Filed: Jun. 29, 2005

(51) Int. Cl.
*B25B 13/46* (2006.01)

(52) U.S. Cl. ..... 81/63.1; 81/180.1; 192/43.2

(58) Field of Classification Search ..... 81/60–63.2, 81/180.1; 192/43, 43.1, 43.2
See application file for complete search history.

(56) References Cited

U.S. PATENT DOCUMENTS 3,290,969 A * 12/1966 Bergquist et al. ..... 81/63.1
3,372,612 A * 3/1968 Rozmus ..... 81/62
4,765,449 A * 8/1988 Peters ..... 192/43.1
6,227,077 B1 * 5/2001 Chiang ..... 81/63.1
6,691,593 B1 * 2/2004 Hu ..... 81/60

* cited by examiner

*Primary Examiner*—Hadi Shakeri
(74) *Attorney, Agent, or Firm*—Rosenberg, Klein & Lee

(57) ABSTRACT

A tool coupling device including a seat body, a ratchet locating mechanism and a transmission member disposed in the seat body. The ratchet locating mechanism has a controlling disc and a working stem projecting from the controlling disc. One end of the working stem has a first stopper block. A second stopper block is connected with the working stem next to the first stopper block. A pair of radially symmetric controlling keys are connected with the working stem next to the second stopper block. The controlling keys serve to drive two chucking pins disposed in the transmission member to move up and down so as to achieve ratchet effect. Therefore, the rotational direction of the tool can be changed.

14 Claims, 7 Drawing Sheets

TOOL COUPLING DEVICE

BACKGROUND OF THE INVENTION

The present invention is related to a hand tool, and more particularly to a tool coupling device applicable to a splined wrench to provide ratchet effect.

FIG. 9 shows a conventional tool-coupling device. The tool-coupling device includes a connecting member 7 having a chucking section 71, a polygonal connecting section 72 and an arresting section 73. The connecting section 72 is formed with an annular chucking groove 74. A fast unplugging unit 75 is disposed at the center of the connecting member 7. The fast unplugging unit 75 serves to control a steel ball 76 to protrude from one side of the arresting section 73 or retract into the arresting section 73. A C-shaped retainer 8 is inlaid in the chucking groove 74. The retainer 8 is bent to form multiple engaging sections 82 and restricting sections 81.

When assembled with a splined wrench 6, the polygonal connecting section 72 is inserted in the splined hole 61 of the splined wrench 6. The chucking section 71 abuts against top face of the wall of the splined hole 61. The restricting sections 81 and engaging sections 82 of the retainer 8 abut against the wall faces of the connecting member 7 and the splined hole 61. Accordingly, the connecting member 7 is coupled with the splined wrench 6. A the connecting member 7 is coupled with the splined wrench 6. A socket can be fitted on the arresting section 73.

The above chucking device only provides a fixing effect. In use, the chucking device can be only one-way rotated. The rotational direction of the splined wrench cannot be changed. As a result, when the splined wrench is turned to a limit, it is necessary to take up the splined wrench and then re-wrench the work piece. This is quite inconvenient and troublesome to a user.

SUMMARY OF THE INVENTION

It is therefore a primary object of the present invention to provide a tool coupling device which can provide ratchet effect for the tool and change the wrenching direction of the tool.

It is a further object of the present invention to provide the above tool coupling device which has fast unplugging effect for quickly replacing the tool.

It is still a further object of the present invention to provide the above tool coupling device in which a first steel ball and a first spring are inlaid in a dent formed on one face of a polygonal column. The diameter of the first steel ball is larger than the diameter of the opening of the dent, whereby the first steel ball can partially protrude from the dent or retract into the dent for locating the tool coupling device in a splined hole of a splined wrench without loosening and shaking.

According to the above objects, the tool coupling device of the present invention includes:

- a seat body having a chucking flange at one end and a polygonal column at the other end for fitting with a wrench, the seat body being formed with an axial receiving space including a first receiving room and a ratchet section sequentially arranged from the chucking flange to the polygonal column;
- a ratchet locating mechanism received in the receiving space of the seat body, the ratchet locating mechanism having a controlling disc and a working stem projecting from the controlling disc, a second stopper block and a pair of radially symmetric controlling keys being connected with the working stem, a third resilient member being fitted on one end of the working stem near the controlling disc; and
- a transmission member, one end of the transmission member being defined as a coupling section for fitting into the receiving space of the seat body, the other end of the transmission member being a connecting section, the coupling section being formed with a left receiving room and a right receiving room in parallel to a diameter of the coupling section, a first chucking pin and a fourth resilient member being inlaid in the left receiving room, a second chucking pin and a fifth resilient member being inlaid in the right receiving room, the controlling keys of the working stem being respectively engaged with the first and second chucking pins, the transmission member being formed with an axial second receiving tunnel having a large diameter section adjacent to the coupling section, the third resilient member being received in the large diameter section, a shoulder section being formed between the large diameter section and the second receiving tunnel for controlling the third resilient member, an end face of the coupling section being formed with several locating holes arranged at equal intervals.

The present invention can be best understood through the following description and accompanying drawings wherein:

DETAILED DESCRIPTION OF THE PREFERRED EMBODIMENTS

Figure 1:
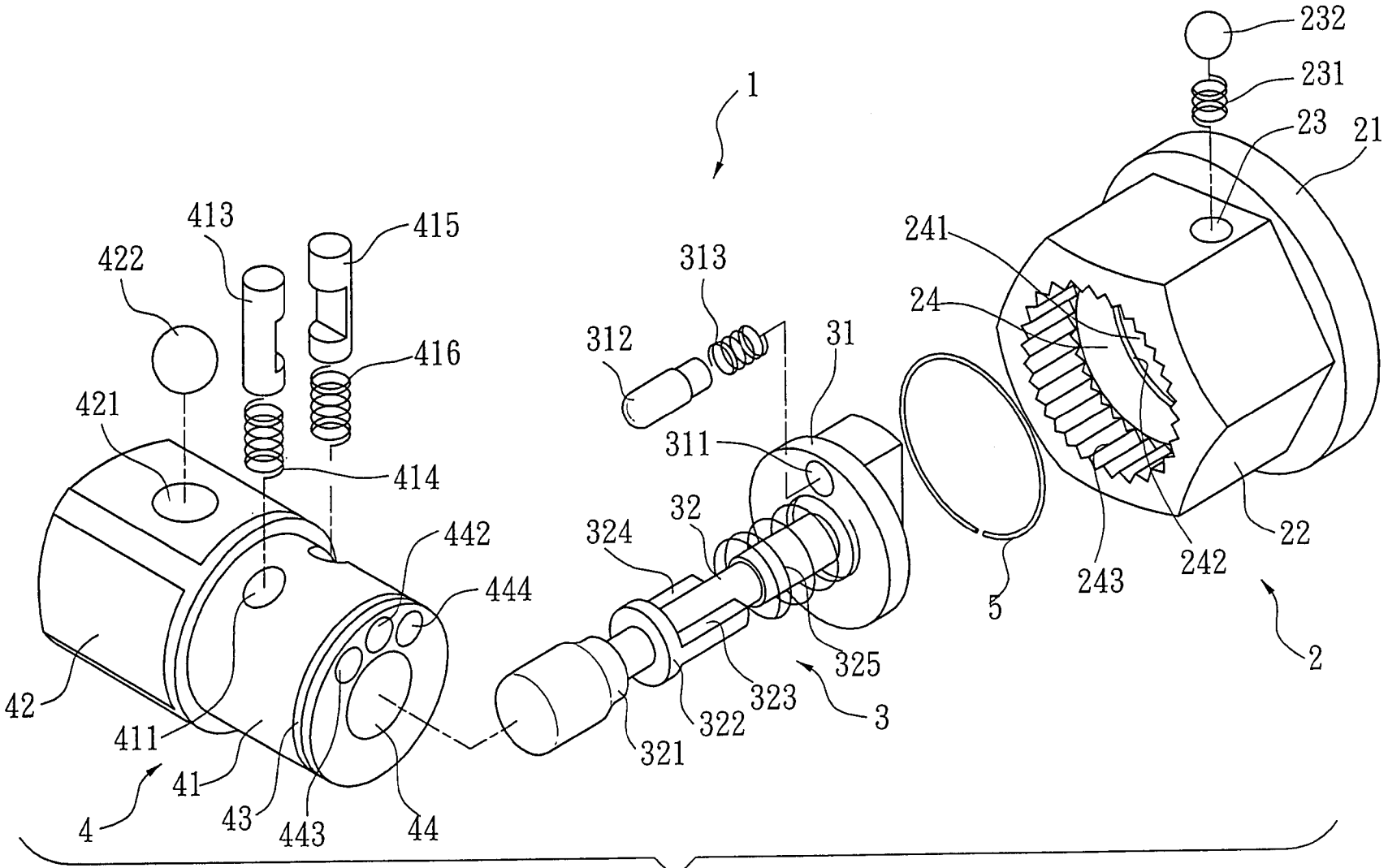
FIG. 1 is a perspective exploded view of the present invention.
Figure 2:
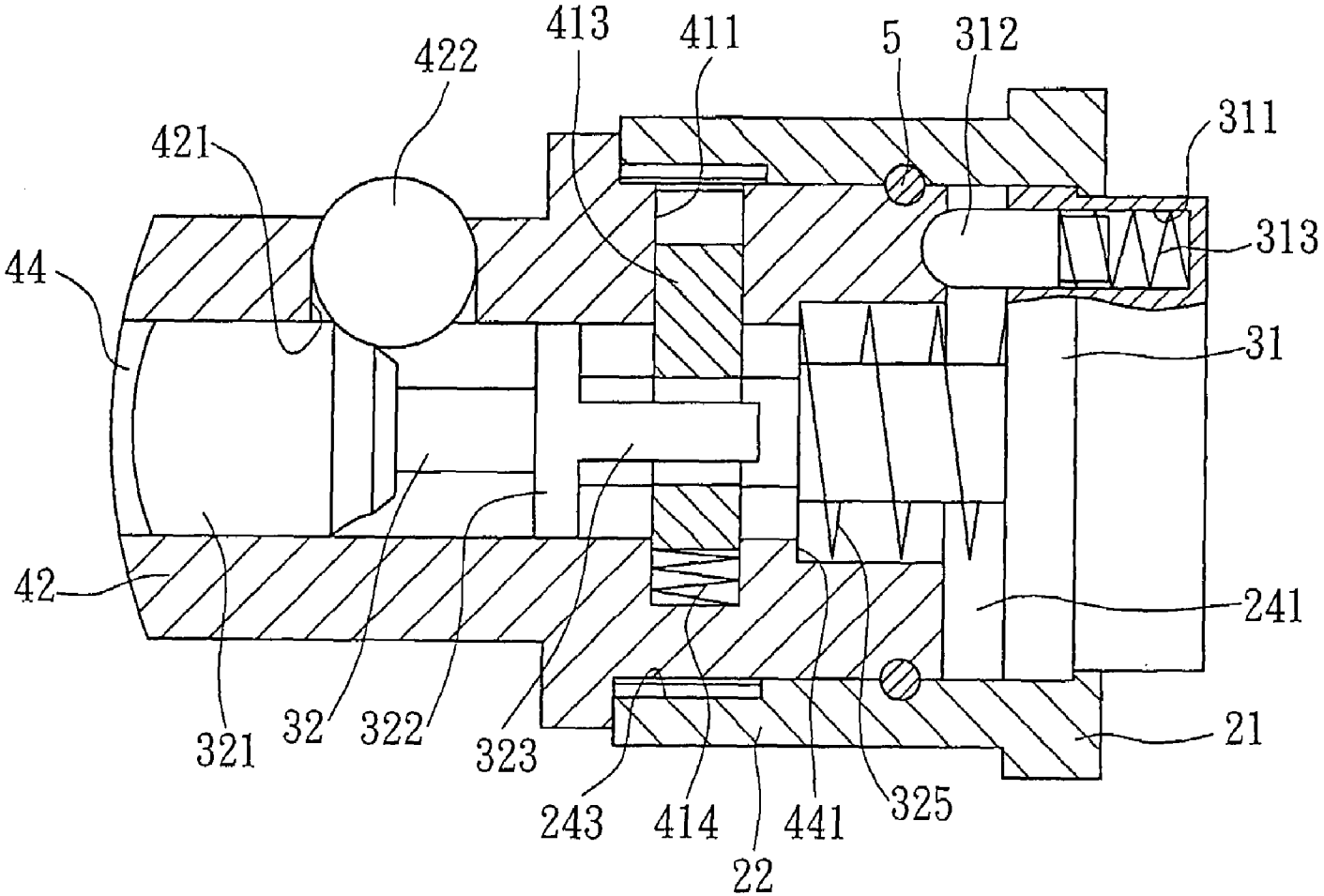
FIG. 2 is a sectional assembled of the present invention.

Please refer to FIGS. 1 and 2. The tool coupling device of the present invention includes a seat body 2 having a chucking flange 21 at one end and a polygonal column 22 at the other end. The polygonal column 22 can be fitted with a splined wrench. One face of the polygonal column 22 is formed with a dent 23 in which a first spring 231 and a first steel ball 232 are inlaid. The first steel ball 232 can abut against the wall of the splined hole of the splined wrench. The seat body 2 is formed with an axial receiving space 24 including a first receiving room 241, a C-shaped latch groove 242 and a ratchet section 243 sequentially arranged from the chucking flange 21 to the polygonal column 22.

The tool coupling device of the present invention further includes a ratchet locating mechanism 3 having a controlling disc 31. A working stem 32 projects from the controlling disc 31. One end of the working stem 32 has a first stopper block 321. A second stopper block 322 is connected with the working stem 32 next to the first stopper block 321. A pair of radially symmetric controlling keys 323, 324 are connected with the working stem 32 next to the second stopper block 322. A third spring 325 is fitted on the other end of the working stem 32 near the controlling disc 31. The controlling disc 31 is formed with an axial second receiving room 311 in which a locating pin 312 and a second spring 313 are accommodated.

The tool coupling device of the present invention further includes a transmission member 4. One end of the transmission member 4 is defined as a coupling section 41 for fitting into the receiving space 24 of the seat body 2. The other end of the transmission member 4 is a connecting section 42. The coupling sect ion 41 is formed with a left receiving room 411 and a right receiving room 412 in parallel to a diameter of the coupling section 41. A first chucking pin 413 and a fourth spring 414 are inlaid in the left receiving room 411. A second chucking pin 415 and a fifth spring 416 are inlaid in the right receiving room 412. The left and right controlling keys 323, 324 of the working stem 32 are respectively engaged with the first and second chucking pins 413, 415. The connecting section 42 is formed with a radial first receiving tunnel 421 in which a second steel ball 422 is plugged. The second steel ball 422 attaches to the first stopper block 321. The coupling section 41 is formed with an annular groove 43. The annular groove 43 and the C-shaped latch groove 242 of the seat body 2 together form an annular passage in which a C-shaped ring 5 is inlaid. The transmission member 4 is further formed with an axial second receiving tunnel 44 having a large diameter section adjacent to the coupling section 41. The third spring 325 is received in the large diameter section. A shoulder section 441 is formed between the large diameter section and the second receiving tunnel 44 for controlling the third spring 325. In addition, the end face of the coupling section 41 is formed with a middle locating hole 442, a left locating hole 443 and a right locating hole 444 arranged at equal intervals. The locating pin 312 can be located in any of the locating holes.

Figure 3:
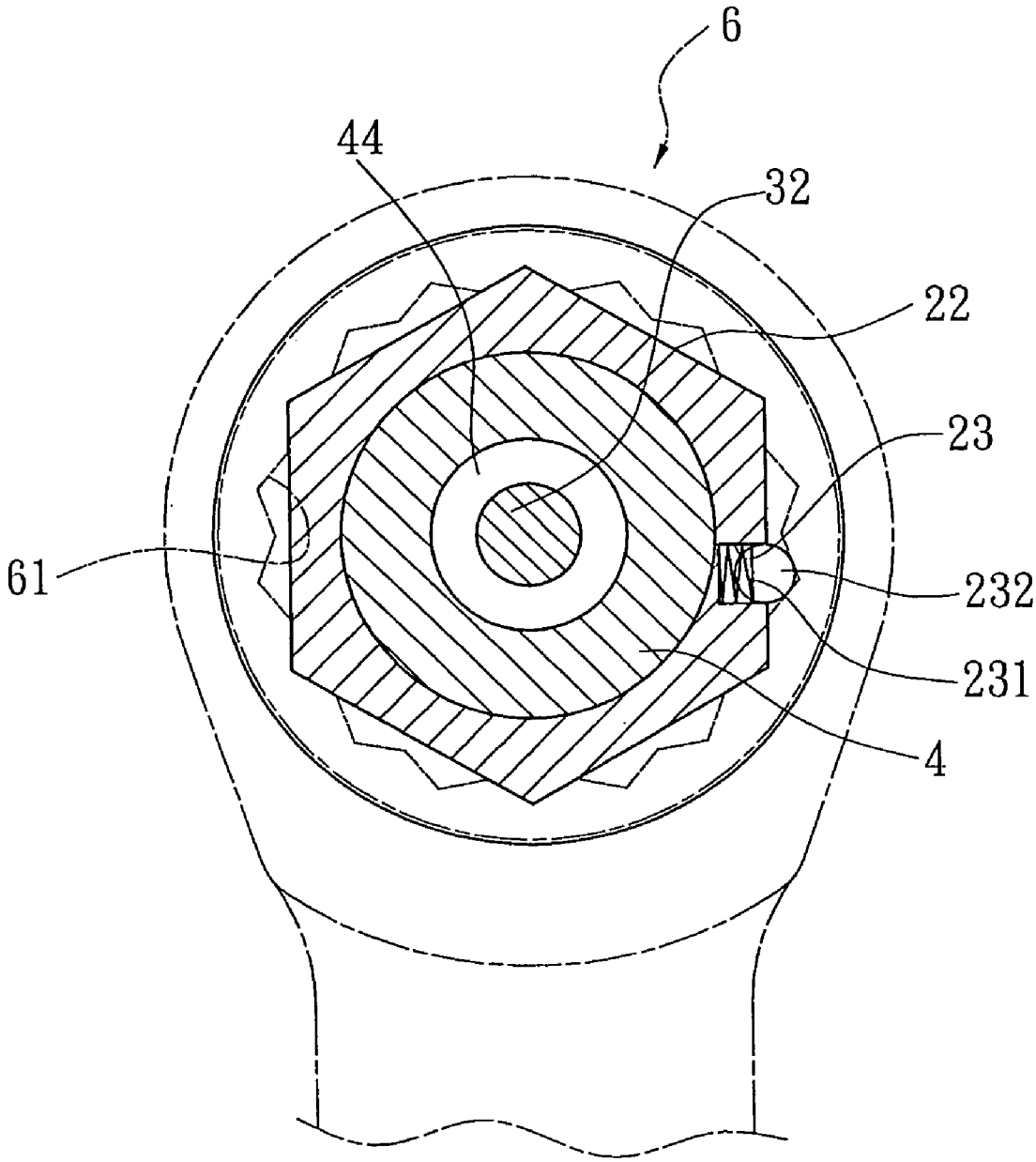
FIG. 3 is a sectional view showing the application of the present invention to a splined wrench.
Figure 4:
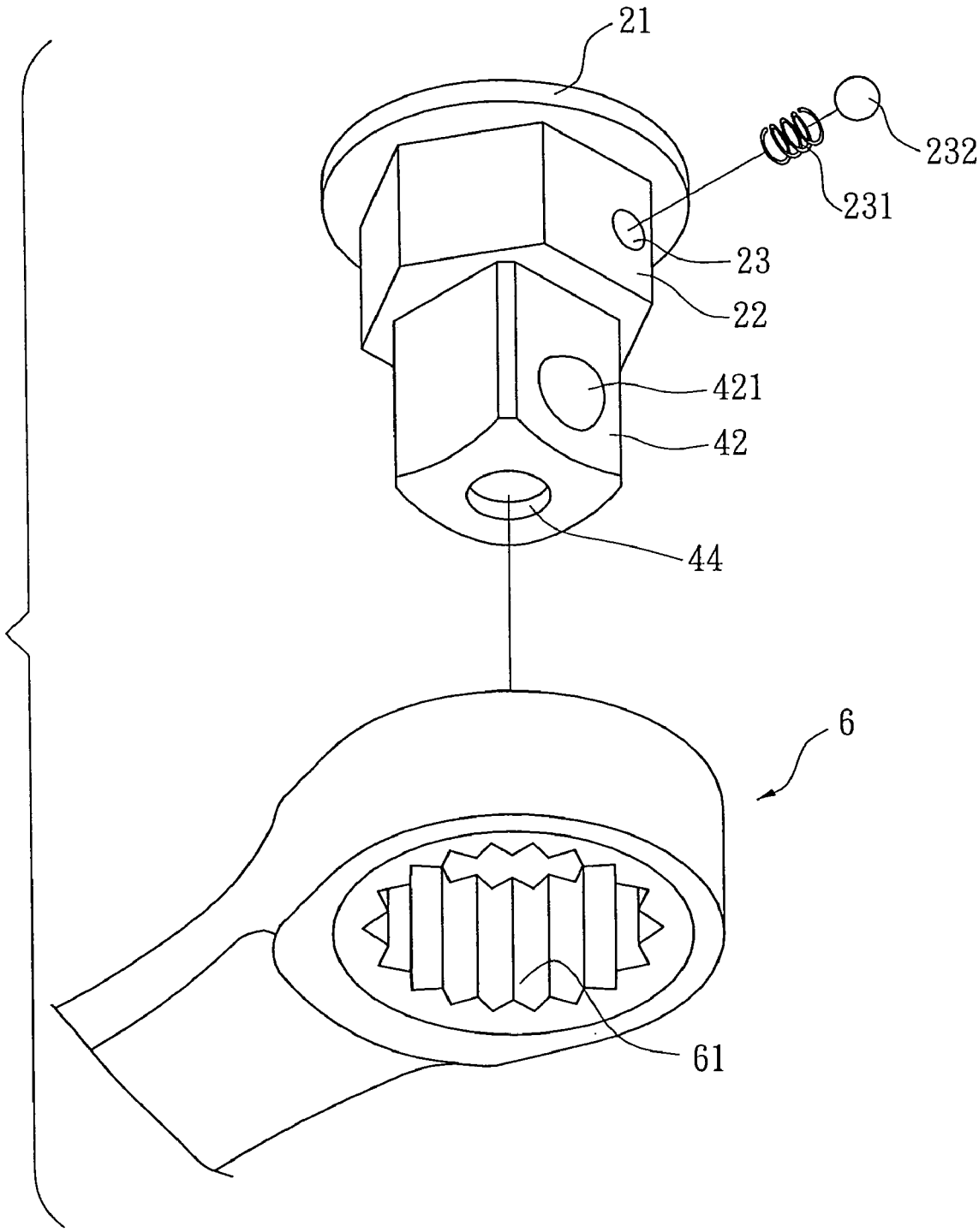
FIG. 4 is a perspective view showing the application of the present invention to a splined wrench.

When applied to a splined wrench 6 having a splined hole 61, as shown in FIGS. 3 and 4, the tool coupling device 1 is fitted into the splined hole 61. The first spring 231 resiliently forces the first steel ball 232 to abut against the wall of the splined hole 61, whereby the polygonal column 22 is chucked in the opposite corners of the splined hole 61. The chucking flange 21 abuts against the end face of the circumference of the splined hole 61 to more firmly and tightly locate the tool coupling device 1 in the splined wrench 6 without slippage.

Figure 5:
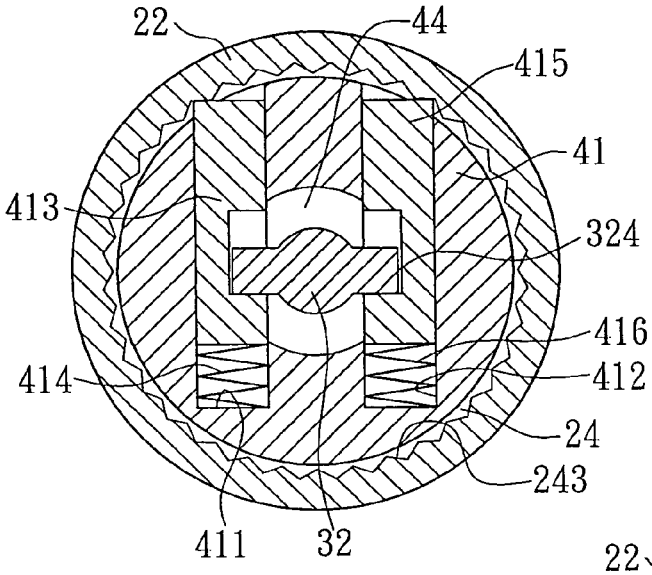
FIG. 5 is a sectional view showing the use of the present invention in one state.

Referring to FIG. 5, when co-used with the splined wrench 6, the ratchet locating mechanism 3 is mounted in the second receiving tunnel 44. In normal state, the locating pin 312 of the controlling disc 31 extends into the middle locating hole 442 of the coupling section 41. The left and right controlling keys 323, 324 of the working stem 32 are respectively engaged with the first and second chucking pins 413, 415 of the coupling section 41. By means of the fourth and fifth springs 414, 416, the first and second chucking pins 413, 415 protrude from the top of the coupling section 41 to engage with the ratchet section 243 of the receiving space 24 of the seat body 2. Under such circumstance, the splined wrench 6 can be clockwise or counterclockwise rotated via the tool coupling device 1.

Figure 6:
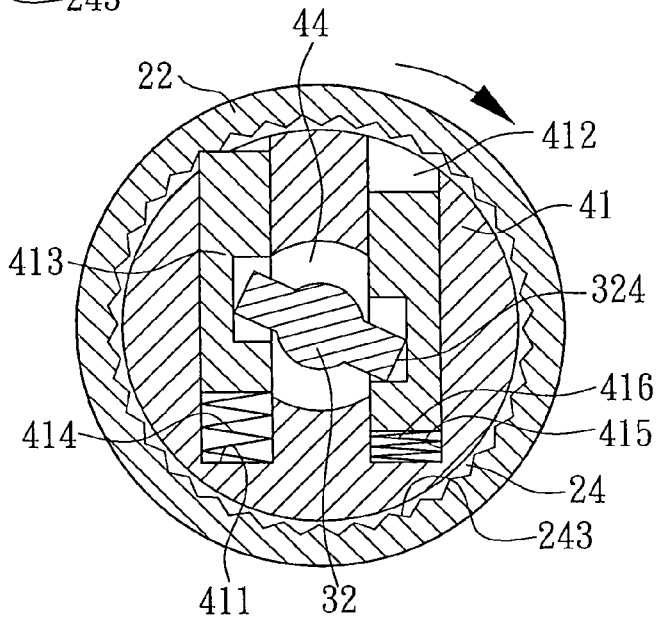
FIG. 6 is a sectional view showing the use of the present invention in another state.

When the controlling disc 31 is clockwise rotated as shown in FIG. 6, the locating pin 312 of the controlling disc 31 is clockwise rotated to extend into the right locating hole 444 of the coupling section 41. In addition, the second chucking pin 415 in the right receiving room 412 of the coupling section 41 is pressed down by the rotating right controlling key 324 to compress the fifth spring 416. The left controlling key 323 is simultaneously rotated so that the fourth spring 414 bounds up, whereby the first chucking pin 413 in the left receiving room 411 moves upward to engage with the ratchet section 243 of the receiving space 24 so as to achieve a ratchet effect. Accordingly, the rotational direction of the splined wrench 6 can be changed.

Figure 7:
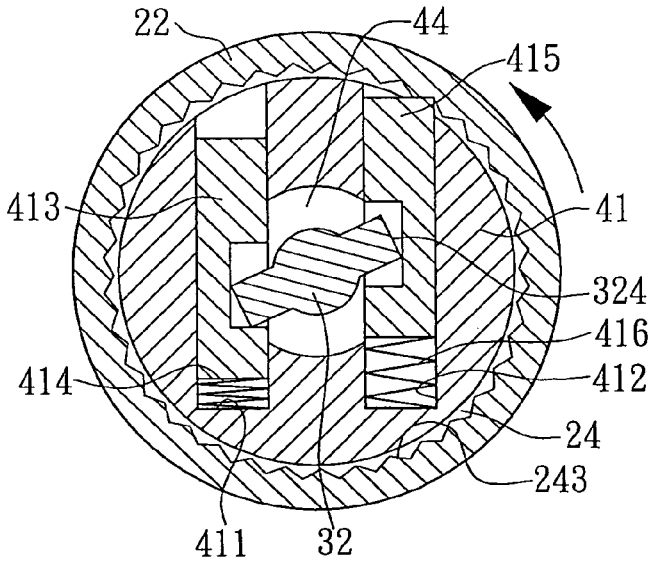
FIG. 7 is a sectional view showing the use of the present invention in still another state.

When the controlling disc 31 is counterclockwise rotated as shown in FIG. 7, the locating pin 312 of the controlling disc 31 is also counterclockwise rotated to extend into the left locating hole 443 of the coupling section 41. In addition, the first chucking pin 413 in the left receiving room 411 of the coupling section 41 is pressed down by the rotating left controlling key 324 to compress the fourth spring 414. The right controlling key 324 is simultaneously rotated so that the fifth spring 416 bounds up, whereby the second chucking pin 415 in the right receiving room 412 moves upward to engage with the ratchet section 243 of the receiving space 24 so as to achieve a ratchet effect. Accordingly, the rotational direction of the splined wrench 6 can be changed.

Figure 8:
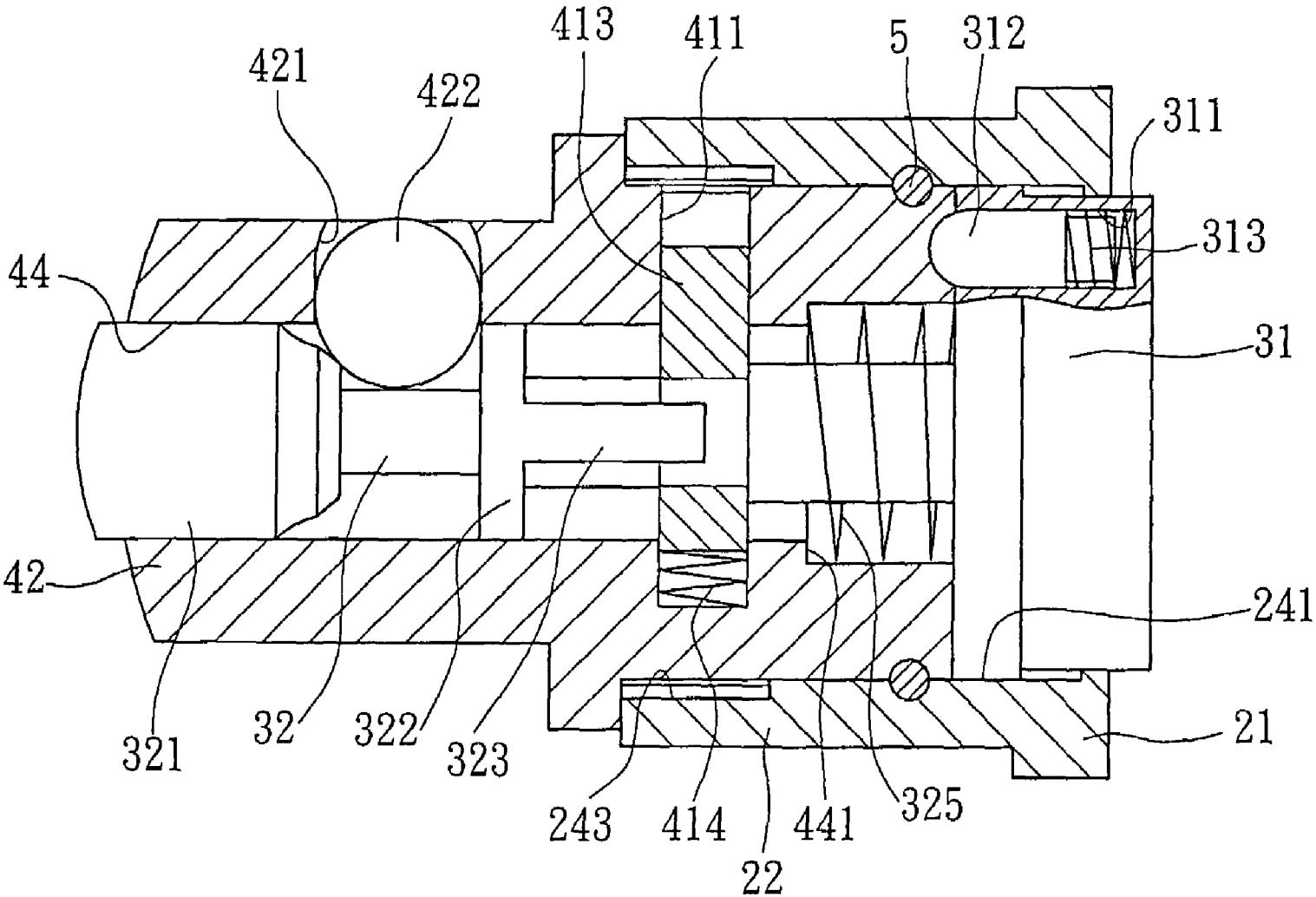
FIG. 8 is a sectional view showing the use of the present invention in still another state.
Figure 9:
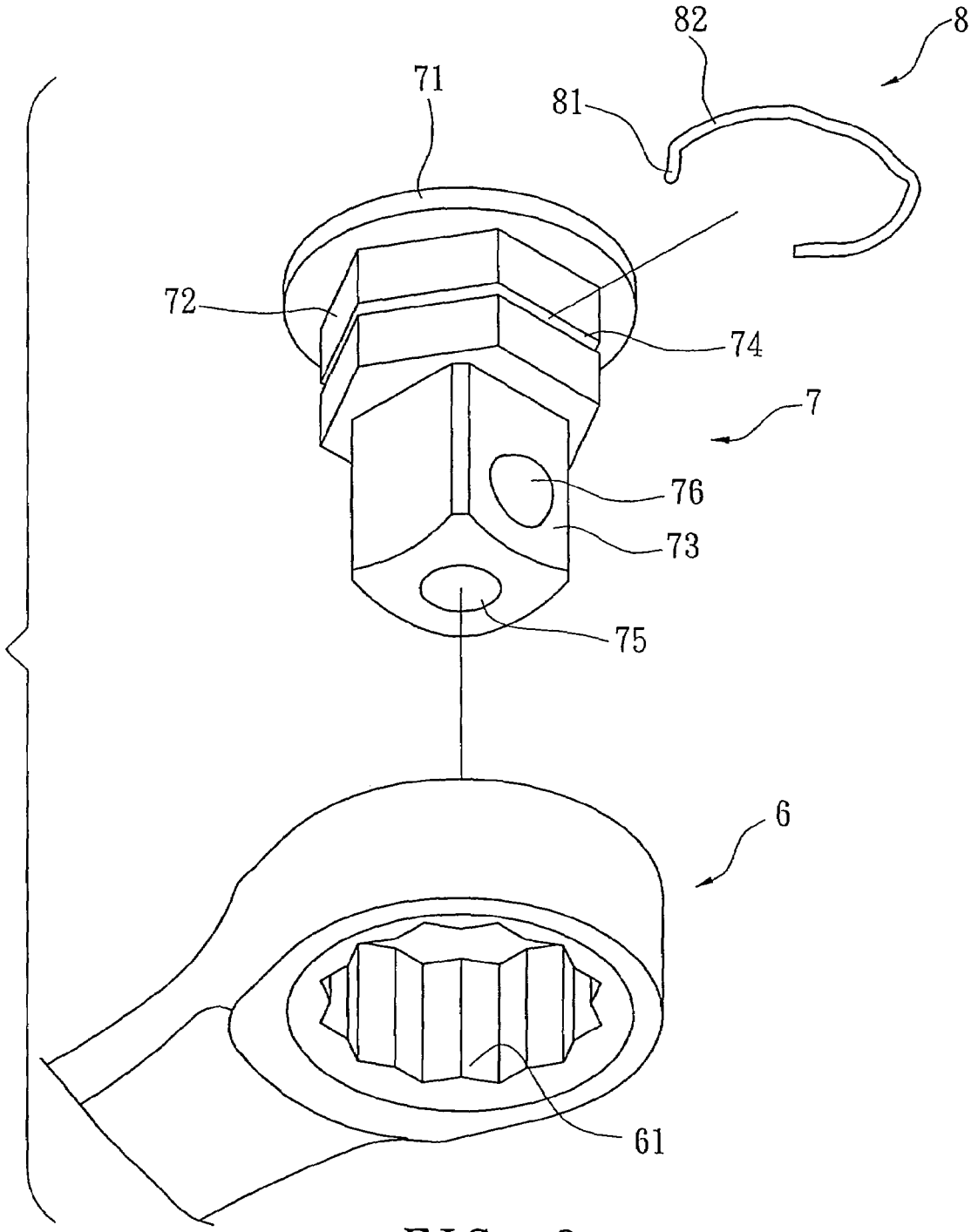
FIG. 9 PRIOR ART
FIG. 9 is a perspective exploded view of a conventional chucking device for tools.

When replacing the tool, as shown in FIG. 8, the controlling disc 31 is pressed down, whereby the third spring 325 is compressed between the shoulder section 441 of the second receiving tunnel 44 and the controlling disc 31. At this time, the second steel ball 422 drops into the space between the first stopper block 321 and the second stopper block 322. Under such circumstance, the connecting section 42 loses its chucking effect and the tool can be fast replaced.

According to the above arrangement, the present invention has the following advantages:

1. The wrenching direction can be changed. By means of rotating the controlling disc, the two controlling keys and the two chucking pins can be driven to engage the ratchet section so as to achieve ratchet effect. Therefore, the splined wrench has ratchet effect and the wrenching direction of the splined wrench can be freely changed in operation.
2. The tool coupling device of the present invention has fast unplugging effect. By means of pressing down the controlling disc, the steel ball of the connecting section can be retracted for quickly replacing the tool. Therefore, the tool coupling device of the present invention not only has better locating effect than the conventional device, but also has fast unplugging effect so that the socket can be quickly replaced.

The above embodiments are only used to illustrate the present invention, not intended to limit the scope thereof. Many modifications of the above embodiments can be made without departing from the spirit of the present invention.

What is claimed is:

1. A tool coupling device comprising:

a seat body having a chucking flange at one end and a polygonal column at the other end for fitting with a wrench, the seat body being formed with an axial receiving space including a first receiving room and a ratchet section sequentially arranged from the chucking flange to the polygonal column;

a ratchet locating mechanism received in the receiving space of the seat body, the ratchet locating mechanism having a controlling disc and a working stem projecting from the controlling disc, a second stopper block and a pair of radially symmetric controlling keys being connected with the working stem, a third resilient member being fitted on one end of the working stem near the controlling disc; and a transmission member, one end of the transmission member being defined as a coupling section for fitting into the receiving space of the seat body, the other end of the transmission member being a connecting section, the coupling section being formed with a left receiving room and a right receiving room in parallel to a diameter of the coupling section, a first chucking pin and a fourth resilient member being inlaid in the left receiving room, a second chucking pin and a fifth resilient member being inlaid in the right receiving room, the controlling keys of the working stem being respectively engaged with the first and second chucking pins, the transmission member being formed with an axial second receiving tunnel having a large diameter section adjacent to the coupling section, the third resilient member being received in the large diameter section, a shoulder section being formed between the large diameter section and the second receiving tunnel for controlling the third resilient member, an end face of the coupling section being formed with several locating holes arranged at equal intervals.

2. The tool coupling device as claimed in claim 1, wherein one face of the polygonal column is formed with a dent in which a first resilient member and a first steel ball are inlaid.

3. The tool coupling device as claimed in claim 2, wherein the first resilient member is a spring.

4. The tool coupling device as claimed in claim 1, wherein a C-shaped latch groove is formed between the first receiving room and the ratchet section.

5. The tool coupling device as claimed in claim 1, wherein the other end of the working stem has a first stopper block.

6. The tool coupling device as claimed in claim 1, wherein the controlling disc is formed with an axial second receiving room in which a locating unit is accommodated.

7. The tool coupling device as claimed in claim 6, wherein the locating unit includes a locating pin and a second resilient member.

8. The tool coupling device as claimed in claim 6, wherein the second resilient member is a spring.

9. The tool coupling device as claimed in claim 1, wherein the connecting section is formed with a radial first receiving tunnel in which a second steel ball is plugged, the second steel ball attaching to the first stopper block.

10. The tool coupling device as claimed in claim 1, wherein the coupling section is formed with an annular groove, the annular groove and the C-shaped latch groove of the seat body together form an annular passage in which a C-shaped ring is inlaid.

11. The tool coupling device as claimed in claim 1, wherein the locating holes are a middle locating hole, a left locating hole and a right locating hole.

12. The tool coupling device as claimed in claim 1, wherein the coupling section is a socket head.

13. The tool coupling device as claimed in claim 1, wherein the locating holes are all spherical holes.

14. The tool coupling device as claimed in claim 1, wherein the resilient members are springs.

* * * * *